US005857574A

United States Patent [19]

Weber

[11] Patent Number: 5,857,574

[45] Date of Patent: Jan. 12, 1999

[54] DISPLAY AND DISTRIBUTION PACKAGING UNIT FOR ARTICLES

[75] Inventor: Peter Weber, Altensteig-Überberg, Germany

[73] Assignee: Brodrene Hartmann A/S, Denmark

[21] Appl. No.: 776,769

[22] PCT Filed: Aug. 17, 1995

[86] PCT No.: PCT/DK95/00335

§ 371 Date: Mar. 20, 1997

§ 102(e) Date: Mar. 20, 1997

[87] PCT Pub. No.: WO96/06025

PCT Pub. Date: Feb. 29, 1996

[30] Foreign Application Priority Data

Aug. 18, 1994 [EP] European Pat. Off. ..... 94112857

[51] Int. Cl.[6] ..... B65D 85/00

[52] U.S. Cl. ..... 206/736; 206/459.5; 206/521.1

[58] Field of Search ..... 206/736, 521.1, 206/459.5, 821

[56] References Cited

U.S. PATENT DOCUMENTS

| | | | |
|---|---|---|---|
| 2,893,619 | 7/1959 | Schwertfeger . | |
| 4,090,658 | 5/1978 | Fukuda | 206/521.1 |
| 4,194,682 | 3/1980 | Congleton et al. | 206/521.1 |
| 4,842,143 | 6/1989 | McKee, Sr. et al. | 206/521.1 |
| 5,009,314 | 4/1991 | Arthurs | 206/821 |
| 5,282,537 | 2/1994 | Wong | 206/736 |

*Primary Examiner*—Paul T. Sewell
*Assistant Examiner*—Nhan T. Lam
*Attorney, Agent, or Firm*—Larson & Taylor

[57] ABSTRACT

A display and distribution packaging unit for articles, especially articles such as eggs assembled into sales units, includes a separate packaging unit (10) embracing the articles or a unit of regularly arranged articles. This packaging unit (10), at least on the display side or sides facing the customer, reproduces a shape typical of that of the article or articles. The display packaging unit also includes a separate display panel (18) adapted to make the final package complete. This display panel (18) has at least one opening (20), through which a part of the packaging unit embracing at least one of the articles with its display side or part of same at least partly protrudes through and above the outside surface of the display panel (18). This display panel (18) in this display position can be connected to the packaging unit (10) embracing the article or articles.

14 Claims, 8 Drawing Sheets

DISPLAY AND DISTRIBUTION PACKAGING UNIT FOR ARTICLES

TECHNICAL FIELD

The present invention relates to a display and distribution packaging unit for articles assembled to form a sales unit.

BACKGROUND ART

A packaging unit of the kind referred to above is the subject of DE-B-1 170 865. This packaging unit serves for packaging e.g. fragile Christmas decorative elements, in German called "Weihnachtskugeln", and consists of an article-supporting member consisting of stacked or laminated pieces of thin plastic sheet material formed with pockets for the individual articles, said supporting member resting in spaced relationship on and being secured to a supporting cardboard base.

In present-day marketing, especially in connection with self-service shops, the customer side requires both an attractive presentation and an informative display, while the motivation to buy may be strengthened, if account has been taken of the typical appearance of certain types of product. On the supplier side, however, there is the problem of marketing costs, making it necessary to take into consideration actual or expected customer wishes as well as the requisite distinction relative to competing products of the same kind.

DISCLOSURE OF THE INVENTION

It is the object of the present invention to provide a display and distribution packaging unit of the kind referred to initially, that may be used generally for packaging different articles, but especially for packaging similar articles assembled so as to form sales units, all in such a manner, that a common and hence rational solution is achieved. A typical example of articles assembled into sales units is the sale of eggs, that are very often traded carton-wise and for this reason, the invention will be explained below with special reference to display packaging units for eggs.

The object stated in the preceding paragraph is achieved with a display and distribution packaging unit according to the invention which consists of two parts being capable of being assembled to form the finished unit.

Of the two parts referred to above, the first-mentioned one constitutes a separate packaging unit serving to accommodate and protect a number of eggs assembled to form a sales unit. Because this separate packaging unit reproduces the typical shape of the packaged articles, i.e. in the present case the eggs, the packaging will attract attention and will already for this reason inspire the customers to buy.

According to the invention, the display and distribution packaging is completed by a separate display panel.

For the supplier side, this arrangement provides for substantial advantages with regard to costs, as on the one hand the separate packaging unit may be mass-produced, while on the other hand the separate display panel can be given an appearance providing the finished packages with the requisite uniqueness.

This means that a wholesale egg-packaging establishment operating on a large scale can fill eggs into an embracing, separate packaging unit for all buyers simultaneously, said packaging unit being capable of mass-production, after which—immediately or later—the various packages can be equipped with display panels decorated according to the wishes of the individual buyers, e.g. shaped and/or coloured, and provided with information and possibly sales slogans corresponding to the expected or consciously provoked wishes of the customers. Another advantage gained by the packaging establishment is the simplification of solely having to carry a single stock of packaging units for embracing the eggs of the same type and appearance for all buyers, thus reducing the costs of storage and stockkeeping, while the use of a separate display panel provides for enhanced possibilities with regard to individually servicing the various customers of the packaging establishment, as well as providing for increased possibilities for placing informative texts and/or pictures on the finished packages.

A common inventive feature of all these possibilities is that the parts of the display side of the separate packaging unit embracing the articles, in the present case the eggs, and being shaped accordingly, by protruding through the opening or openings cooperate with the external face of the display panel to produce a three-dimensional decorative effect, likewise capable of being supplemented in individual appearance, e.g. with regard to colouring.

In this manner, the present invention combines the possibilities for technical improvement of the manufacturing process with the possibilities for achieving individual appearances capable of being supplemented.

The display and distribution packaging unit according to the present invention is not limited to the case, in which the display panel has a number of openings equal to the number of articles. The number of openings may also be less, making it possible to vary the three-dimensional effect by otherwise covering or highlighting the remaining parts of the packaging unit embracing the eggs.

Further, according to the invention, an arrangement is possible, in which the extent of said display panel substantially corresponds to the extent of the base surface of the separate packaging unit embracing said article or articles.

Another possibility is that the size of the base surface of said display panel is smaller than that of the separate packaging unit embracing said article or articles. For this reason, an additional decorative effect may be achieved, if the display panel is in the form of a wide strip, the width of which is less than a transverse dimension of the separate packaging unit embracing said articles. For example a number of wide strips embracing a separate packaging unit can be united to form a cross.

The display panel may be secured to the separate packaging unit embracing the articles in various ways. Thus, the display panel may be secured to said separate packaging unit by means of adhesive, clamping or stapling means, possibly combined with other securing or anchoring facilities in the region of the projecting parts of the separate packaging unit embracing the articles. It is likewise possible to provide the display panel with one or more outer flanks, with which the display panel can grasp said separate packaging unit externally. In this case also, connections based on adhesion or mechanical engagement may be used.

Further embodiments of the connection of a display panel to the separate packaging unit embracing the articles consist according to the invention in providing said packaging unit with at least one post protruding on the display side of said packaging unit and serving as a support for the display panel and having an adhesive surface adapted to adhere to the lower side of the display panel, when the latter is placed upon it. In this case also, the display panel may be provided with downwardly protruding anchoring means adapted to go into mechanical engagement with cooperating means, e.g. slits, when being placed upon the packaging unit embracing the articles.

Advantageous embodiments of the display packaging unit according to the invention, the effects of which—beyond what is self-evident—are explained in the following detailed part of the present description.

BRIEF DESCRIPTION OF THE DRAWINGS

In the following detailed portion of the present description, the invention will be explained in more detail with reference to the exemplary embodiments of a display packaging unit according to the invention shown in the drawings, in which FIG. 1 in perspective and partly in separated view shows a first exemplary embodiment of a display and distribution packaging unit.

DESCRIPTION OF THE PREFERRED EMBODIMENTS

Figure 1:
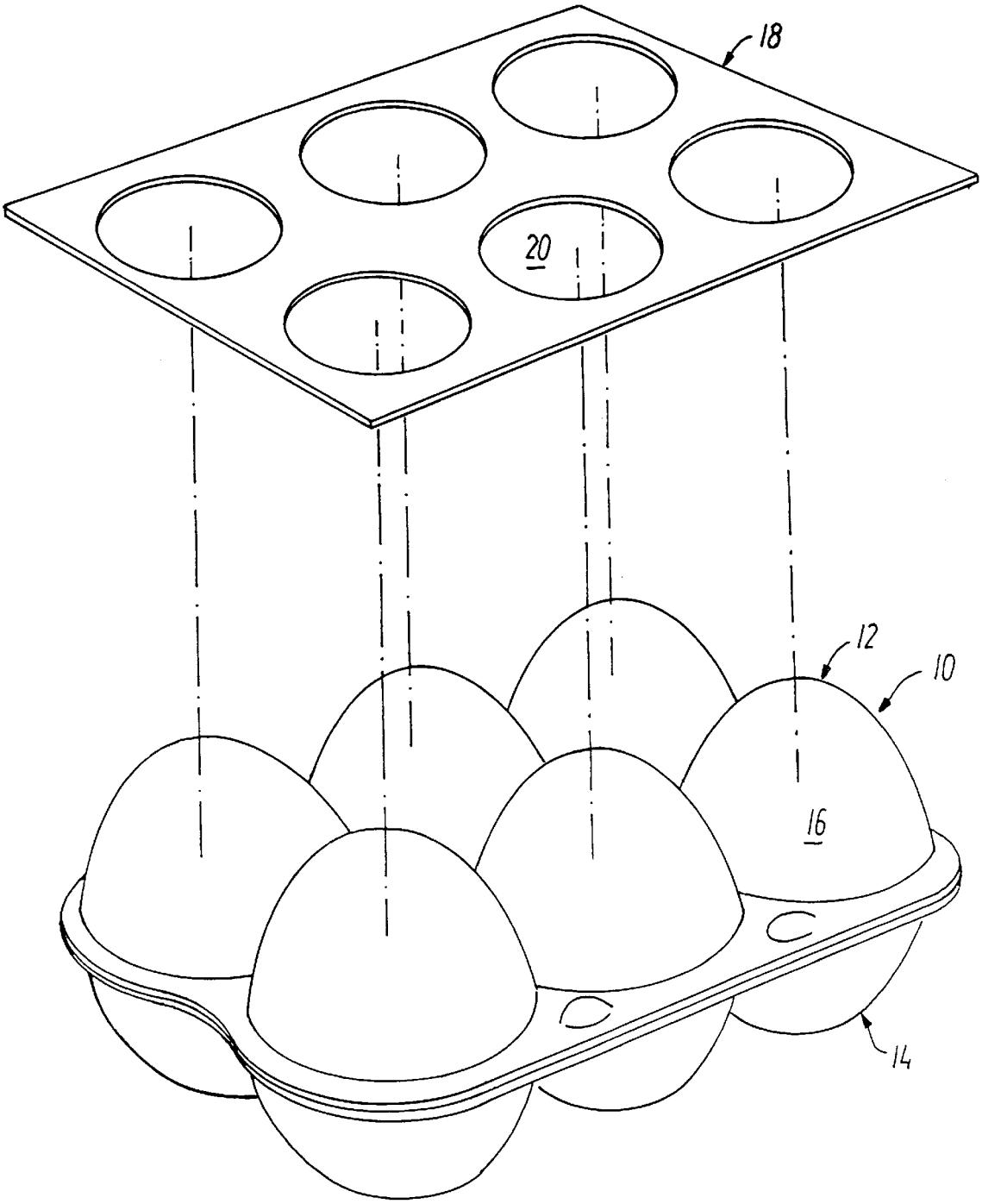

FIG. 1 shows diagramatically and partly in an exploded view an example of the general construction of a display and distribution packaging unit according to the present invention. The packaging unit is designed for the sale of eggs, in the present case in a number of six, arranged in a unit ready for sale and embraced by the self-contained packaging unit 10 shown in the lower part of the figure. The packaging unit 10 consists of an upper part 12 and a lower part 14 in the form of two shell parts, that may be separate or hinged to each other. Of these shell parts, at least the upper part 12 facing a customer is shaped in conformance with the objects being embraced—i.e. in the present case eggs—by means of shell pockets 16. In the exemplary embodiment shown, this also applies to the lower part 14.

Further, the display and distribution packaging unit according to the present invention comprises a separate display panel 18, in the example shown having openings 20 in a number equal to the number of shell pockets 16. In the exemplary embodiment shown, the display panel 18 has an extent substantially corresponding to that of the base surface of the separate packaging unit 10.

Figure 2:
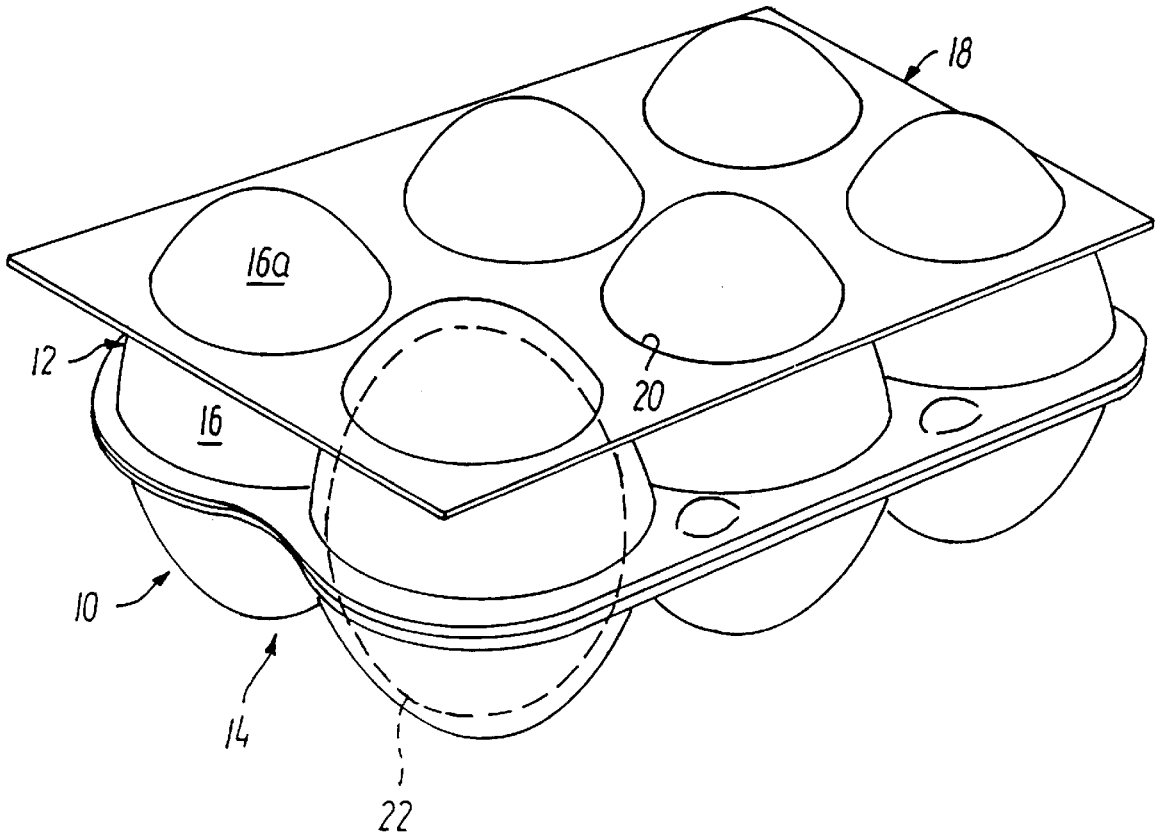
FIG. 2 shows the unit of FIG. 1 in the assembled state.

The openings 20 are dimensioned in such a manner, that the display panel 18 can be placed on the shell pockets 16 of the upper part 12 in such a manner, that the shell pockets 16 at least with an apical portion 16*a* protrude above the outside face of the display panel 18 as shown in FIG. 2. In this manner, a three-dimensional decorative effect is created. In the present example, this effect will emphasize the shape of an egg 22 indicated with a broken line in FIG. 2.

The manufacture of the packaging unit 10 offers the advantage of mass production acceptable to a great number of customers of a wholesale egg-packaging establishment without objections with regard to competitive uniqueness. In spite of this, there are numerous possibilities for achieving uniqueness by varying the appearance of the display panel, e.g. with regard to colour and matter printed on it. Thus, it is sufficient for the wholesale packaging establishment to keep in stock only a few types of the separate packaging units intended to embrace the articles, i.e. the eggs, and only with regard to the display panels is it necessary to comply with the wishes of the buyers.

The display panel 18 may be connected to the packaging part in various ways. A number of exemplary embodiments are described below, but they should not in any way be regarded as exhaustive.

Figure 3:
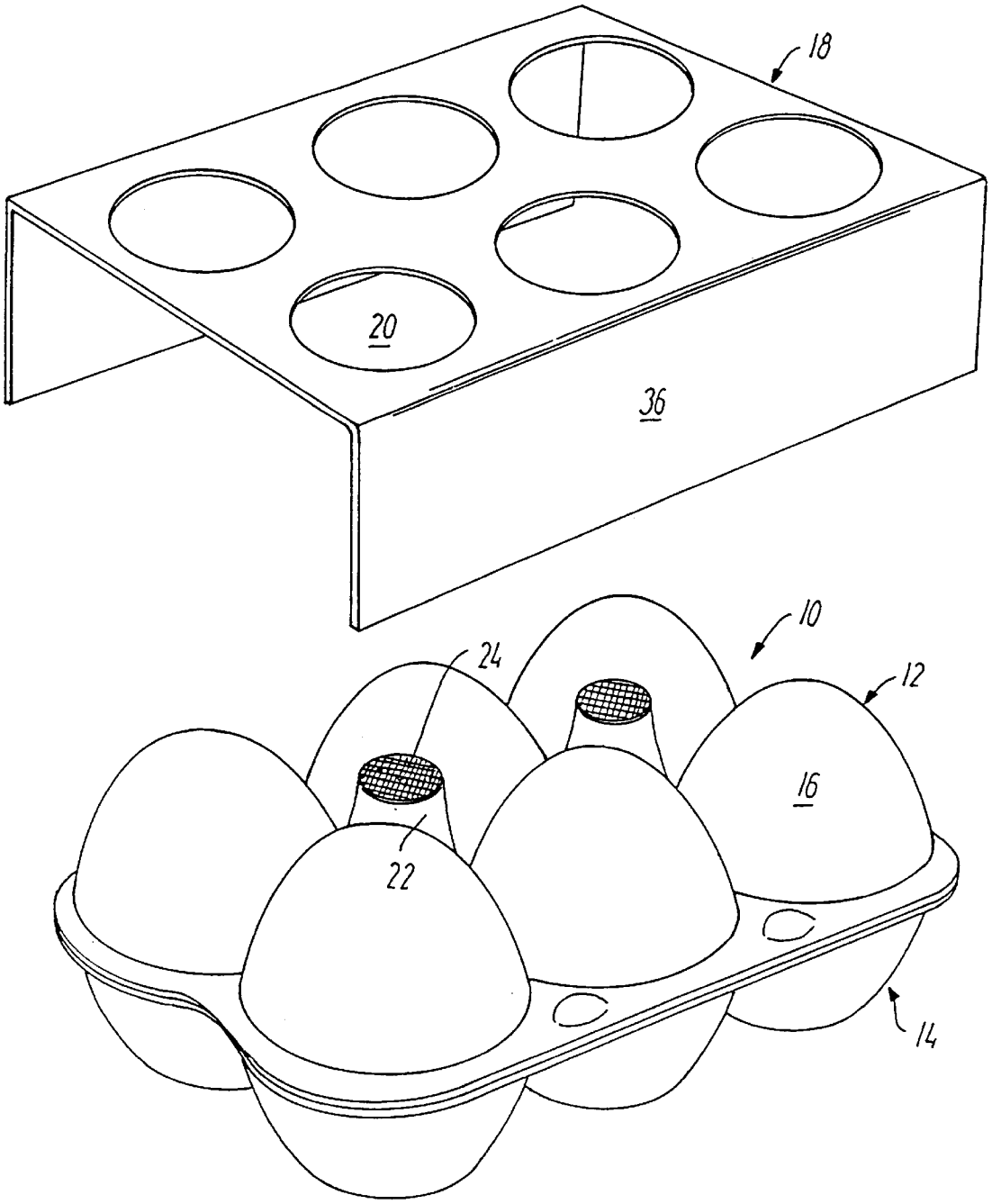
FIGS. 3–8 show a second, a third, a fourth, a fifth, a sixth and a seventh exemplary embodiment respectively of the display and distribution packaging unit according to the present invention.

FIG. 3 shows an exemplary embodiment of an adhesive connection for a display panel 18 placed on the upper part 12 of a packaging unit 10. For this purpose, the packaging unit 10 comprises posts 22 protruding upwardly on the visible side facing the customer, said posts 22 being lower than the shell pockets 16 by an amount corresponding to the height of the apical portions 16*a*. The top of each post 22 comprises a flat 24 serving as a supporting surface for the display panel 18 and capable of forming an adhesive connection with the display panel 18 placed on it by means of an adhesive, indicated by cross-hatching.

Figure 4:
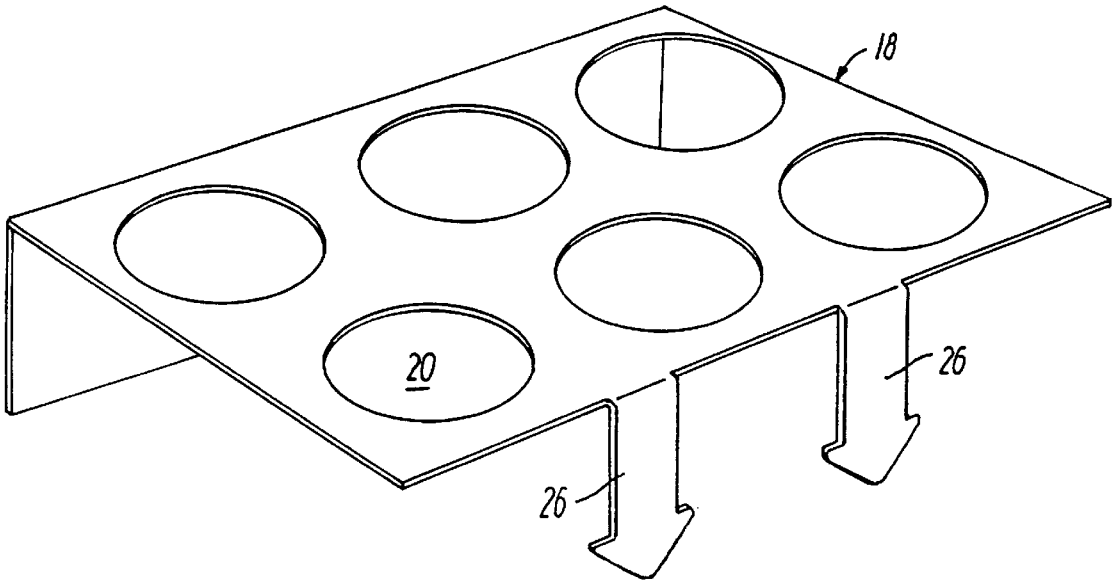
Figure 4:
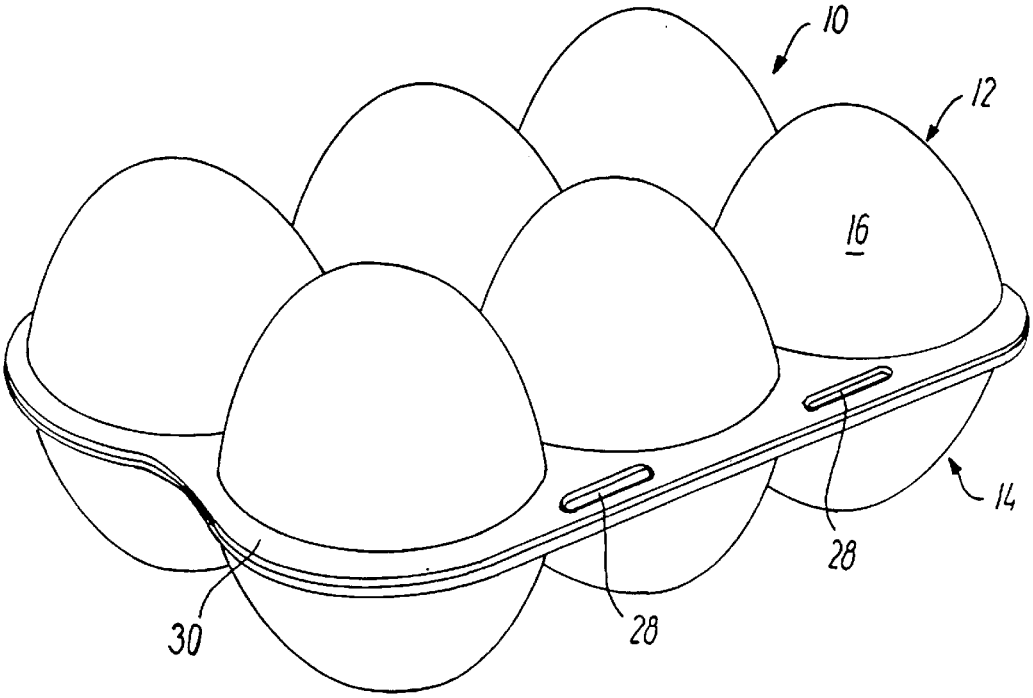

FIG. 4 shows an exemplary embodiment of an engagement connection for the display panel 18 placed upon the upper part 12 of a separate packaging unit 10. For this purpose, the display panel 18 comprises arrow-shaped anchoring flaps 26 protruding downwardly from at least one edge, said flaps 26 coming into anchoring engagement with slots 28 provided in edge flanges 30 of the upper part 12 and the lower part 14 respectively, when the display panel is placed upon the separate packaging unit, cf. also FIG. 2.

The attachment of a display panel 18 placed on the separate packaging unit 10 may also be achieved in the edge regions of the openings 20 provided in the display panel 18.

Figure 5:
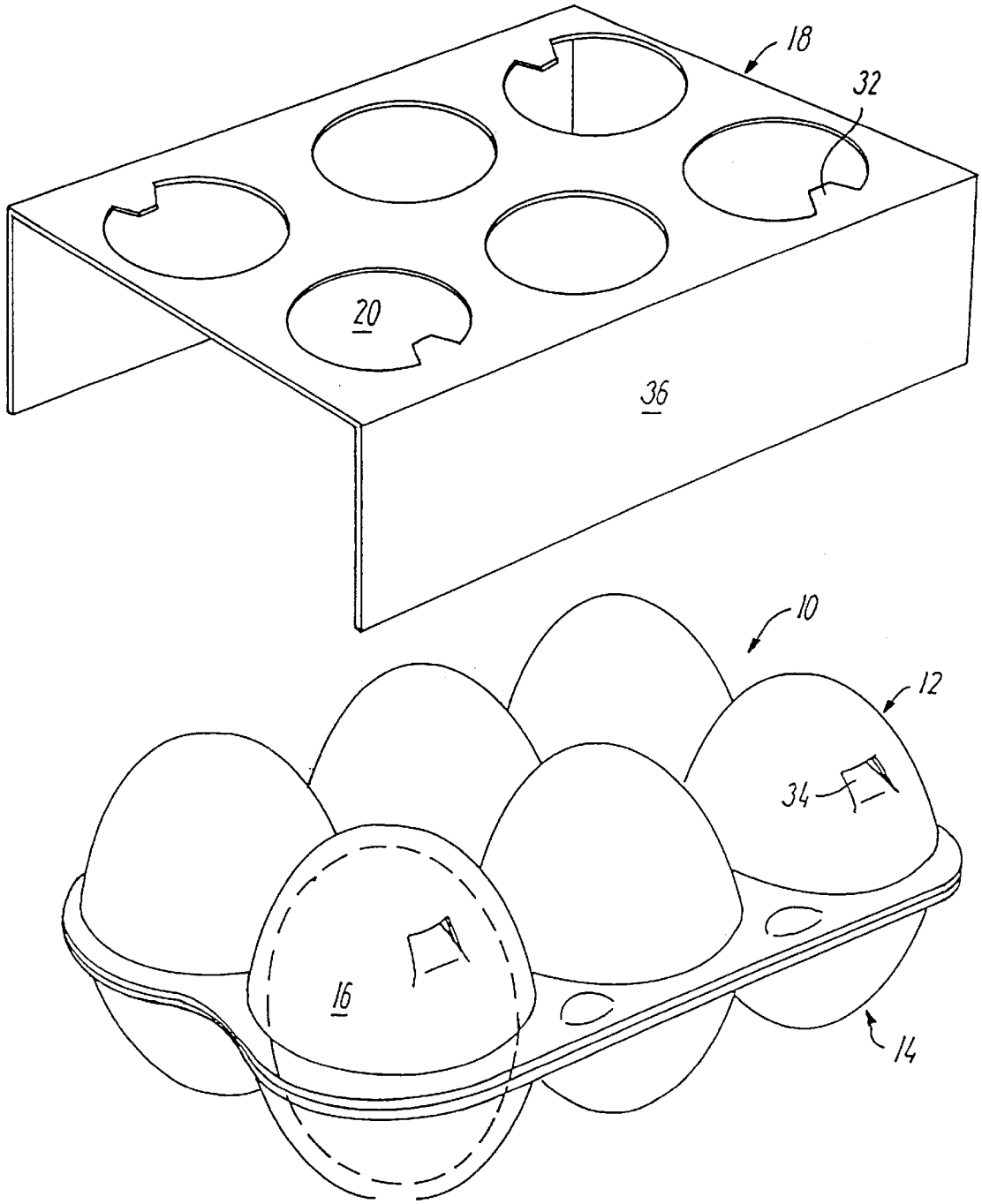

FIG. 5 shows an exemplary embodiment of such an attachment mode. In this example, at least some of the openings 20 comprise a pawl 32 protruding into the opening 20. Correspondingly, the shell pocket 16 of the upper part 12 of the separate packaging unit 10 is provided with a cutout 34, into which the pawl 32 comes into engagement, when the display panel 18 is placed on the unit 10. Other types of engagement connections between the edges of the opening 20 and the shell pockets 16 are possible within the scope of the invention. Likewise, adhesive connections between the edges of the openings 20 and the shell pockets 16 are possible.

Likewise, the invention may be carried out in connection with a separate display panel 18 having a smaller number of openings than the number of objects, i.e. eggs, embraced by the separate packaging unit 10. In this manner, it is possible to achieve additional three-dimensional effect variations without loss of the advantages of the invention initially explained.

Further, it is possible within the scope of the invention to let the display panel 18 have a smaller base surface than that of the separate packaging unit 10.

These variations are explained in more detail with reference to the exemplary embodiments according to FIGS. 6–8.

Figure 6:
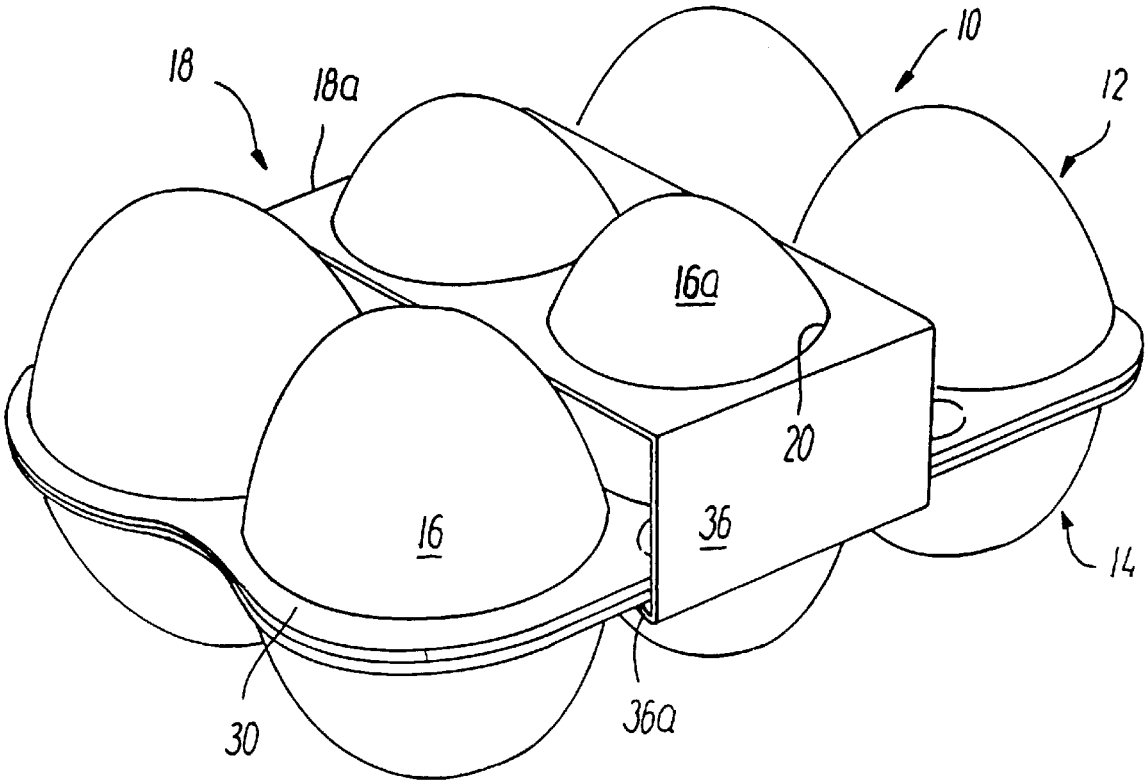

FIG. 6 shows an exemplary embodiment also consisting of a separate packaging unit 10—as described in more detail above—and of a display panel 18*a*, the base surface of which is smaller than that of the packaging unit 10, the display panel being in the form of a wide strip 18*a* having a smaller width than a transverse dimension of the packaging unit 10. Accordingly, only the two central shell pockets 16*a* protrude through display openings 20, while the two pairs of shell pockets 16 on both sides of the wide strip 18*a* protrude outside of the latter.

The wide strip 18*a* is anchored to the packaging unit 10 by means of outer flanks 36 formed on the strip 18*a* and grasping the edge flange 30 on the packaging 10 with an edge flange 36*a*. Such an outer flank 36 is also available for decorative and informative purposes.

Figure 7:
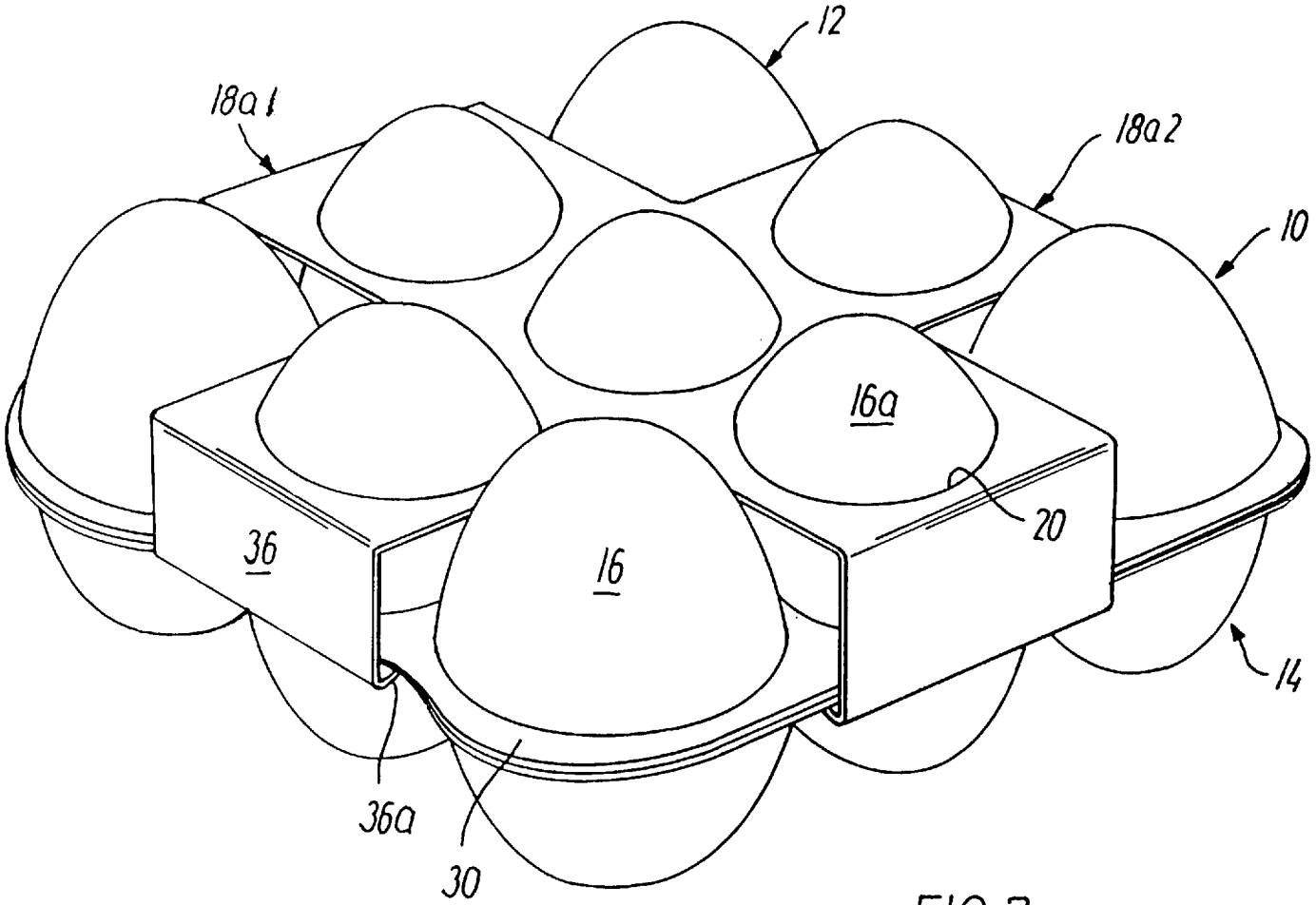

FIG. 7 shows a variant of the exemplary embodiment referred to above, in which two wide strips 18*a*1 and 18*a*2 are united to form a cross. This cross is anchored to the packaging unit 10 in the same manner as explained with reference to FIG. 6. The exemplary embodiment according to FIG. 7 comprises a number of nine shell pockets 16, of which five cooperate with the display openings 20 in the wide strips to achieve the display effect described above, while the four shell pockets 16 situated at the corners of the packaging unit protrude freely in the upper direction.

Figure 8:
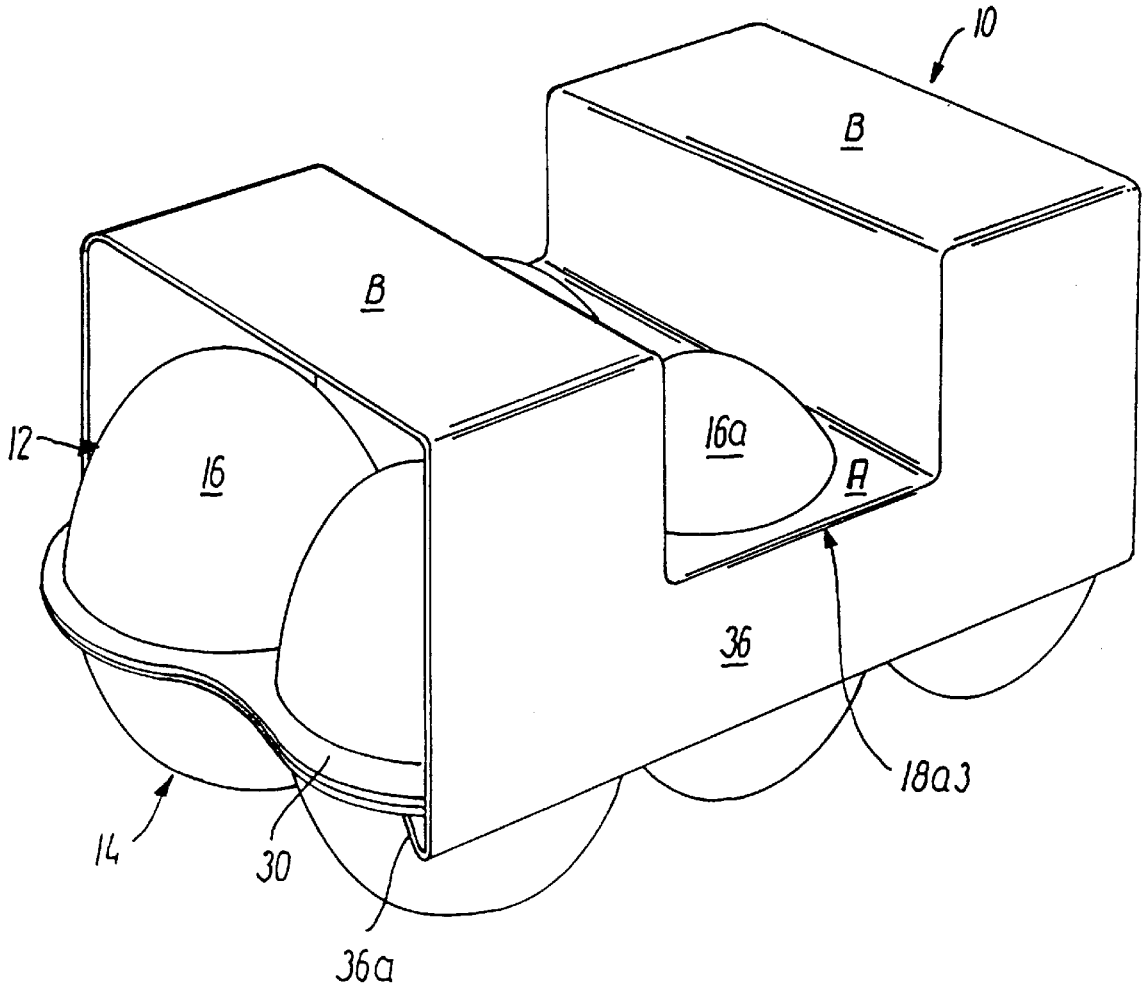

FIG. 8 shows a further variant, in which the display panel 18*a*3 comprises a lower-level part A and two higher-level parts B, each of the latter partly surrounding a pair of upper shell pockets 16 on either side of the lower-level part A. In this example also, the outer flank 36 is clamped to the edge flange 30 on the separate packaging unit 10 by means of an edge flange 36*a*.

In summary, it should also be noted with respect to the exemplary embodiments shown FIGS. 3–5 that these exemplary embodiments also comprise the possibility of clamping the display panel to the edge flange 30 of the packaging unit by using an outer flank 36, adapted to be secured to the upper part 12 adhesively or by mechanical engagement, or by using an edge flange 36*a* as shown in FIGS. 6–8 to achieve a holding connection with the separate packaging unit 10.

I claim:

1. Display and distribution packaging apparatus for articles comprising:

a discrete packaging unit which embraces a sales unit of regularly arranged articles, said packaging unit including a display side having (a) a planar base surface and (b) respective protrusions extending away from said base surface which reproduce a three dimensional shape of an underlying portion of each of the articles in the sales unit thereunder;

a discrete display panel extending over said display side continuously from one side of said base surface over and to an opposite side of said base surface, said display panel including at least one opening between the one side and opposite side of said base surface through which a portion of at least one of said protrusions extends; and a connecting means for connecting said display panel to said packaging unit.

2. Display and distribution packaging apparatus as claimed in claim 1, wherein said display panel covers substantially all of said display side of said packaging unit.

3. Display and distribution packaging apparatus as claimed in claim 1, wherein a number of said protrusions exceeds a number of said openings.

4. Display and distribution packaging apparatus as claimed in claim 1, wherein said display panel covers only a portion of said display side of said packaging unit.

5. Display and distribution packaging apparatus as claimed in claim 4, wherein said display panel is a strip which extends between non-adjacent ones of said protrusions.

6. Display and distribution packaging apparatus as claimed in claim 5, wherein said display panel is cross shaped.

7. Display and distribution packaging apparatus as claimed in claim 1, wherein said connecting means is an adhesive applied between edges of said opening and contacting portions of an adjacent said protrusion extending through said opening.

8. Display and distribution packaging apparatus as claimed in claim 1, wherein said connecting means is a mechanical connection between a portion of an edge of said opening and an adjacent part of said protrusion extending through said opening.

9. Display and distribution packaging apparatus as claimed in claim 8, wherein said portion of the edge of said opening is a pawl and said adjacent part of said protrusion is a cutout.

10. Display and distribution packaging apparatus as claimed in claim 1:

wherein said display side further includes at least one post protruding away from said base surface in a same direction as said protrusions on which said display panel is engaged for support; and wherein said connecting means is an adhesive applied between an end of said post and an adjacent part of said display panel.

11. Display and distribution packaging apparatus as claimed in claim 1, wherein said connecting means includes (a) holding members extending transversely to said display panel towards said base surface of said display side and (b) cutouts in said base surface in which respective said holding members are engaged.

12. Display and distribution packaging apparatus as claimed in claim 1, wherein said connecting means includes an outer flank extending transversely from said display panel for grasping said packaging unit.

13. Display and distribution packaging apparatus as claimed in claim 12, wherein said connecting means further includes an adhesive between a part of said outer flank and an adjacent part of said packaging unit.

14. Display and distribution packaging apparatus as claimed in claim 12, wherein said connecting means further includes a mechanical engagement means for engaging a part of said outer flank with an adjacent part of said packaging unit.

* * * * *